US005103980A

United States Patent [19]

Kuchenbecker

[11] Patent Number: 5,103,980

[45] **Date of Patent: * Apr. 14, 1992**

[54] CARTON OPENING AND RECLOSURE FEATURE HAVING VENT OPENING

[75] Inventor: Morris W. Kuchenbecker, Neenah, Wis.

[73] Assignee: James River Corporation of Virginia, Richmond, Va.

[ * ] Notice: The portion of the term of this patent subsequent to Dec. 31, 2008, has been disclaimed.

[21] Appl. No.: 616,357

[22] Filed: Nov. 21, 1990

[51] Int. Cl.[5] ..... B65D 5/54

[52] U.S. Cl. ..... 206/621; 206/625; 206/628

[58] Field of Search ..... 206/621, 625, 628, 622

[56] References Cited

U.S. PATENT DOCUMENTS

| | | | |
|---|---|---|---|
| 3,167,238 | 1/1965 | Smith | 206/625 |
| 3,399,820 | 9/1968 | Foster et al. . | |
| 4,043,503 | 8/1977 | Meyers et al. | 206/625 |
| 4,285,461 | 8/1981 | Meyers | 206/621 |
| 4,687,104 | 8/1987 | Ielmini . | |
| 4,738,365 | 4/1988 | Prater . | |
| 4,746,019 | 5/1988 | Prater . | |
| 4,951,824 | 8/1990 | Kuchenbecker et al. . | |
| 4,986,466 | 1/1991 | Colby | 229/132 |

*Primary Examiner*—Stephen Marcus
*Assistant Examiner*—Christopher T. McDonald
*Attorney, Agent, or Firm*—Sixbey, Friedman, Leedom & Ferguson

[57] ABSTRACT

A paperboard carton blank is disclosed which includes first and second panels having side walls connected thereto by scored fold lines formed between a respective side wall and a respective edge the panel, with one of the side walls of the first panel and one of the side walls of the second panel being congruent and at least one predetermined edge of the second panel being devoid of a side wall. A sealing flap is provided which extends a predetermined distance from a predetermined edge of one of the side walls of the first panel with the predetermined edge of the side wall being that edge which extends adjacent to the predetermined edge of the second panel of a carton formed from the blank. An opening means is also provided which is defined by the predetermined edge of the second panel and regions of weakness formed in the second panel which extend from the predetermined edge of the second panel for permitting access to the inside of the formed carton. The opening means includes an opening force receiving means defined by the regions of weakness, the predetermined edge of the second panel and a line of weakness which extends between the regions of weakness substantially parallel to and spaced a predetermined distance greater than or equal to the predetermined distance of the sealing flap from the predetermined edge of the second panel. Once opened, the carton formed from the above blank is capable of reclosure to form a vent opening which permits steam to escape.

24 Claims, 3 Drawing Sheets

CARTON OPENING AND RECLOSURE FEATURE HAVING VENT OPENING

BACKGROUND OF THE INVENTION

1. Technical Field

The present invention relates to a carton blank for forming a carton, and a carton which is to be filled with a consumable product accessible through an opening in the carton. More particularly, the invention pertains to an opening feature formed in a top panel of the carton which provides a reliable and a consistent opening when opened by the consumer while reducing the amount of material required in the manufacturing of such carton.

2. Background Art

Paperboard cartons have been manufactured with a variety of opening features which allow the consumer access to the contents of the cartons. These features may consist of perforations, herringbone cuts, adhesive weaknesses, as well as other means of providing a point along the top panel, side panel or hinge lines where the carton may be most readily opened. A further opening feature commonly employed in cartons of this type is that of double-cut scores, as shown in U.S. Pat. No. 3,399,820 to Foster et al. with the top panel including a overlapping panel which overlaps the front side wall of the container.

The above-mentioned opening feature is formed by way of double-cut scores; i.e., an inner and outer cut in the paperboard which run parallel to one another and include cuts extending into the overlapping panel to form a tear flap. By so providing these cut score lines, when the consumer applies an upward force or opening force on the tear flap provided between the pairs of cut score lines, ply separation occurs in the regions between the inner and outer cut score lines. Continued pulling of the tear flap causes complete separation of the opening flap to allow the consumer unobstructed access to the contents of the carton.

Similar opening features are disclosed in U.S. Pat. Nos. 4,746,019 and 4,738,365 to Prater. As with the above-mentioned patent, a line of weakness is provided in a panel of a respective carton where ply separation of the panel is permitted to occur when the consumer applies an opening force to the tear flap. The ply separation occurs between two pairs of reverse cut lines which are formed at least halfway through the panel of the carton. These paperboard blanks are formed in a matrix which consists of a plurality of forming dies and counters. Therefore, by requiring the extended tear flap to be part of an overlapping panel, and consequently requiring an overlapping panel, when forming the blanks in a matrix, a greater amount of paperboard material will be required for each carton blank formed.

U.S. Pat. No. 4,687,104 to Ielmini discloses a similar carton and carton blank having score lines formed in the outer and inner surfaces of the top and the overlapping panel. These score lines are referred to as extending partially through the outer and inner surfaces of the carton and carton blank. Given this assertion, the carton formed by the reverse score lines of U.S. Pat. No. 4,687,104 which includes an overlapping panel requires no less material than with the cartons set forth above. These cartons, as explained above, require an overlapping panel which in turn adds to the amount of paperboard material necessary for the manufacture of such cartons.

In an attempt to overcome the shortcomings associated with the foregoing prior art, U.S. Pat. No. 4,951,824 issued to Kuchenbecker et al., the disclosure of which is hereby incorporated herein by reference, discloses a carton having a reliable opening feature for use in containers wherein it is imperative that the carton remain impervious to moisture or other environmental effects. The opening feature includes an uncut line of weakness extending substantially parallel to a partially cut line of weakness with each of the lines of weakness being formed from the same side of the carton blank. However, this carton also requires the presence of an overlapping panel encompassing a tear flap to permit easy opening of the carton.

U.S. Pat. No. 3,399,820 issued to Foster et al. discloses a carton incorporating a similar opening feature while eliminating the overlapping panel necessary for the positioning of a lift tab. Instead, Foster et al. incorporates the lift tab into the top panel. However, because the lift tab is entirely adhered to the extension panel, the consumer may have difficulty initiating the opening of the carton and once open, the carton is not readily reclosable.

In addition to the aforementioned shortcomings of the various prior art references, each of these cartons must be opened and remain in an open condition when the contents of the carton are heated in a microwave oven in order to permit the egress of steam from within the carton. This may often result in the contents of the carton being dispersed out of the open carton when overheated.

As can be seen from the foregoing, there is clearly a pressing need for a carton of the above-mentioned type which will provide a reliable, and consistent opening feature that is capable of being opened with ease by the consumer, and which will not retard the structural integrity of the carton when opened and, moreover, will result in a reclosable container having a vent opening formed integrally therein while reducing the amount of paperboard material necessary for the manufacture of such carton.

SUMMARY OF THE INVENTION

It is an object of the subject invention to overcome the deficiencies of the prior art. In particular, it is an object of the present invention to provide a carton having a reliable opening feature which is capable of opening smoothly without retarding the structural integrity of the carton.

It is another object of the subject invention to provide a paperboard blank for forming a carton having such an opening feature wherein the amount of paperboard material required to produce such carton is reduced.

Yet another object of the present invention is to provide a carton in which the consumer may heat or cook the contents while in the carton, as well as consume the food contained therein directly from the carton. The consumer is then capable of readily gaining access to the contents of the carton without destroying its structural integrity.

A further object of the present invention is to provide a reliable opening feature wherein after the carton is opened, it may be readily and reliably reclosed, and which when reclosed provides a vent therein which permits steam to escape during the heating of the contents therein.

These, as well as various additional objects and advantages of the subject invention are achieved by producing a paperboard carton blank including a first panel having side walls connected thereto by scored fold lines formed between a respective side wall and a respective edge of the first panel. A second panel is provided having side walls connected thereto by scored fold lines formed between a respective side wall and a respective edge of the second panel with one of the side walls of the first panel and one of the side walls of the second panel being congruent with at least one predetermined edge of the second panel being devoid of a side wall. A sealing flap extends a predetermined distance from a predetermined edge of one of the side walls of the first panel with the predetermined edge of the side wall being that edge which extends adjacent to the predetermined edge of the second panel of a carton formed from the blank. An opening means is also provided which is defined by the predetermined edge of the second panel and regions of weakness formed in the second panel which extend from the predetermined edge of the second panel for permitting access to the inside of the formed carton. The opening means includes an opening force receiving means defined by the regions of weakness, the predetermined edge of the second panel and a fold line extending between the regions of weakness and substantially parallel to the predetermined edge of the second panel. The fold line is spaced from the predetermined edge of the second panel a distance equal to or greater than the predetermined distance of the seal flap.

This carton blank is then used to form a paperboard carton having an opening feature which allows ready access to the contents of the carton, as well as being capable of reclosure to form a vent opening which permits steam to escape. The carton for containing a product placed therein includes a bottom panel, a top panel, a plurality of side walls extending from the bottom panel to the top wall and a seal flap extending a predetermined distance from a predetermined edge of one of the side walls, the predetermined edge of the side wall being that edge which extends adjacent to a predetermined edge of the top panel. An opening means defined by the predetermined edge of the top panel and regions of weakness formed in the top panel and extending from the predetermined edge of the top panel for permitting access to the inside of the carton is provided. The opening means includes an opening force receiving means defined by the regions of weakness, the predetermined edge of the top panel and a fold line extending between the regions of weakness and substantially parallel to the predetermined edge of the top panel. The fold line being spaced from the predetermined edge of the top panel a distance equal to or greater than the predetermined distance of the seal flap. Additionally, a vent is formed in the sealing flap for permitting the egress of steam from within the carton when the opening means is reclosed and the product contained therein is heated. The vent being a cut-out section of the sealing flap along an edge of the sealing flap which extends substantially parallel to the predetermined edge of one of the side walls.

Additional advantages of the subject invention will become apparent from the figures and the following description of the preferred embodiment.

DETAILED DESCRIPTION OF THE PREFERRED EMBODIMENTS

Figure 1:
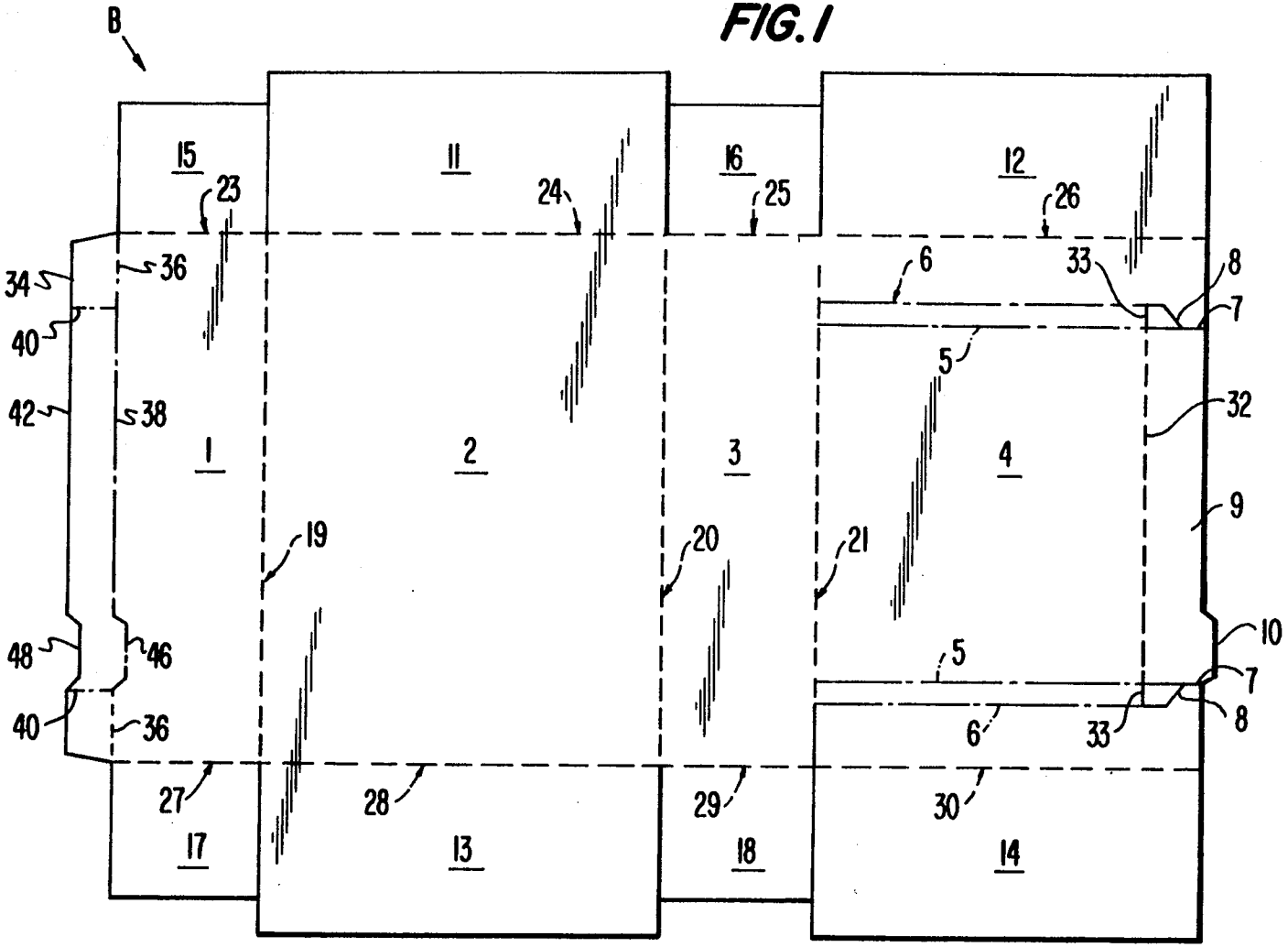
FIG. 1 is a top view of the paperboard carton blank used in forming the carton in accordance with a preferred embodiment of the invention.

Referring now to FIG. 1, there is shown a carton blank for forming the carton set forth in FIGS. 2–5. The carton blank B of FIG. 1 comprises a front panel 1, a bottom panel 2, a back panel 3 and a top panel 4. Like numerals will be used to designate like parts in each of the figures illustrated. The bottom panel 2 is flanked on either side by side walls 11 and 13 while top panel 4 is flanked on either side by side walls 12 and 14. The front panel 1 and rear panel 3 are likewise flanked by side walls 15 and 17, 16 and 18, respectively, which when constructed cooperate to form the end closures of the finished carton. The carton blank B is preferably formed of a paperboard material. This paperboard material may be coated with polyethylene or other similar barrier materials. These materials may also be chosen to be suitable for use in a microwave oven. Those skilled in the art will certainly appreciate that the specific coating selected will depend directly on the intended use of the resulting carton.

Each of the panels 1, 2, 3 and 4 and the side walls 11–18 are hingedly connected to one another by way of score lines 19–21 and 23–30. By providing such score lines, the carton blank can be readily formed into the carton illustrated in FIG. 2.

Illustrated in FIG. 1 is a pair of partially cut lines of weakness 5 which are positioned inward of and parallel to partially cut lines of weakness 6. As with the various prior art opening features, the partially cut lines of weakness 6 are cut into an upper or outer surface of the top panel 4. The partially cut lines of weakness 6 can be cut 5% to 85% of the way through the thickness of the top panel; however, a depth of approximately one-half of the thickness of the paperboard is preferred. The partially cut lines of weakness being similar to those discussed in the prior art above. Similarly, the partially cut lines of weakness 5 are formed in the lower or inner surface of the top panel 4 and thus form the inner lines of weakness of the finished carton. As with the partially cut lines of weakness 6, the partially cut lines of weakness 5 are cut 5% to 85% through the thickness of the paperboard material, and preferably through 50% of the thickness.

Referring further to FIG. 1, it can be noted that the partially cut line of weakness 5 initially includes lead in through cuts 7 which are cut through the entire thickness of the paperboard material and extend colinear with the partially cut lines of weakness 5. The partially cut lines of weakness 6 extend substantially parallel to the partially cut lines of weakness 5 and include a convergent portion 8 which extends at an angle from the partially cut line of weakness 6 to the partially cut line of weakness 5 and intersects the partially cut line of weakness 5 at the termination of the through-cut 7. In doing so, this intersection forms a reliable starting point for ply separation between the lines of weakness and the through-cut ensures the proper initiation and termination points of an opening flap 9. Thus, the respective pairs of lines of weakness 5 and 6 form respective regions of weakness.

The opening flap 9 additionally includes a tab 10 which extends from the opening flap 9 for aiding in the ability of the consumer to grasp the leading edge of the opening flap 9. The opening flap 9 is additionally hingedly connected to the top panel 4 by a line of weakness 32. This line of weakness 32 may be a partially cut line of weakness similar to those partially cut lines of weakness formed in the outer surface of the top panel 4. The line of weakness 32 may also be a perforation; however, in accordance with a preferred embodiment of the invention, the line of weakness 32 is a crease score fold line. The crease score fold line or the partially cut score line of weakness 32 would be preferred in that the perforations would extend through the entire thickness of the top panel 4 and may lead to leakage or contamination of the contents of the carton. However, if such is not of a concern for the particular contents of the carton, a perforation may readily be used in this instance. The line of weakness 32 is additionally provided with through cuts 33 which extend through the entire thickness of the paperboard material between each of the respective pairs of the partially cut lines of weakness 5 and 6. The through cuts 33 extend substantially colinear with the line of weakness 32. The significance of this through cut will be set forth in greater detail hereinbelow.

A sealing flap 34 is hingedly connected to the sidewall 1 by way of crease score fold sections 36 and a partially cut score line 38. The significance of the partially cut line 38 will be discussed in greater detail hereinbelow. Additionally, partial cut score lines 40 extend from the partially cut score line of weakness 38 to the exposed edge 42 of the sealing flap 34 in order to form a release area 44 (illustrated in FIGS. 3–5) in the sealing flap 34. An extension 46 of the release area 44 is formed in the sidewall 1 which corresponds to the tab 10. Consequently., when the carton is in an erect condition the surface of the extension 46 will be sealingly adhered to the tab 10 thus aiding in the initiation of the ply separation at the release area 44.

Additionally formed in the sealing flap 34 is a cutout region 48 which conforms precisely to the tab 10. As is well known in the art, when paperboard carton blanks are formed from an elongated sheet of paperboard material, a plurality of blanks are simultaneously cut with the blanks being adjacent one another in a manner to conserve the maximum amount of paperboard material. Therefore, during the formation of the blank in accordance with FIG. 1, the tab 10 of an adjacent carton blank will extend into and be formed from the cutout 48 of the blank illustrated in FIG. 1. In addition to the conservation of paperboard material during the manufacturing of a plurality of blanks, the cutout 48 serves a significant purpose in the finally erected carton as will be discussed in greater detail hereinbelow.

Figure 2:
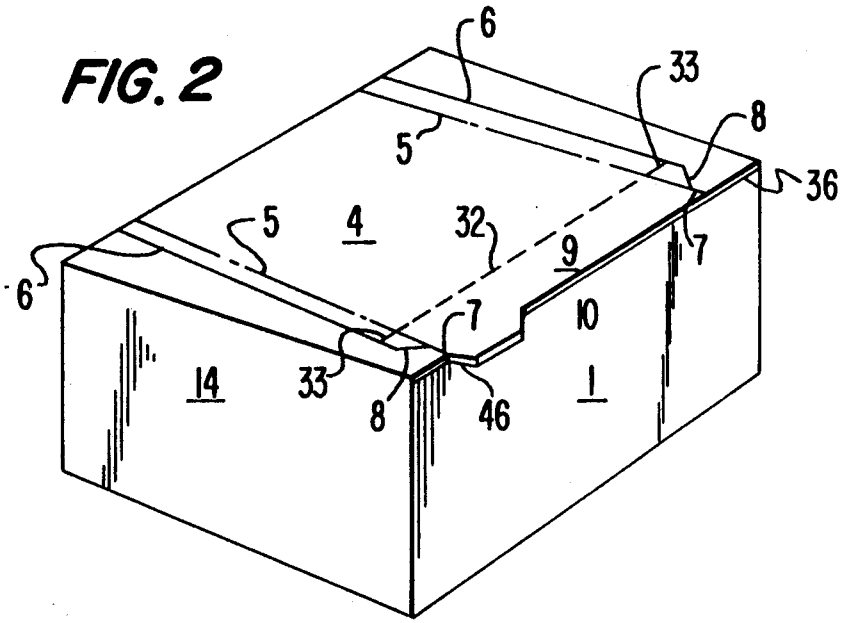
FIG. 2 is a perspective view of the paperboard carton in accordance with the preferred embodiment of the invention with the carton in its closed condition.

FIG. 2 illustrates the paperboard blank B in its erected condition. As can be seen therefrom, the tab 10 extends from the opening flap 9 beyond the sidewall 1 and, consequently, the release area 46 is exposed. When the carton is to be opened by the consumer, the consumer will grasp the tab 10 in a convenient manner and begin to peel the tab 10 back along the top panel 4 as best illustrated in FIG. 3.

Figure 3:
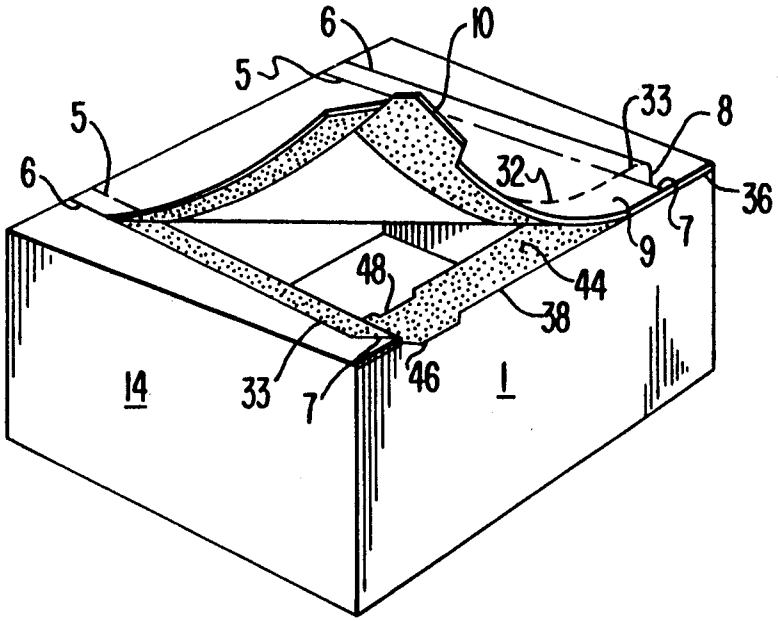
FIG. 3 is a perspective view of the carton of FIG. 2 in its partially open condition.

As can be seen from FIG. 3, when the tab 10 is initially peeled back, ply separation begins to occur in the release area 44 with the lead in through cut 7 smoothly initiating the ply separation between a first pair of partially cut lines of weakness 5 and 6. As the consumer continues to draw the tab 10 away from the fold line 36 and partially cut lines of weakness 38 and 40, ply separation will continue to travel along the region of weakness. The further lifting of the tab 10 will cause ply separation between the second pair of partially cut lines of weakness 5 and 6. This ply separation is again initiated by the lead in through cut 7 and partially cut region 8. Further the ply separation is enhanced in that the regions of weakness convey toward one another from front to rear. This feature being set forth in greater detail in commonly assigned U.S. Pat. No. 4,951,824.

Figure 4:
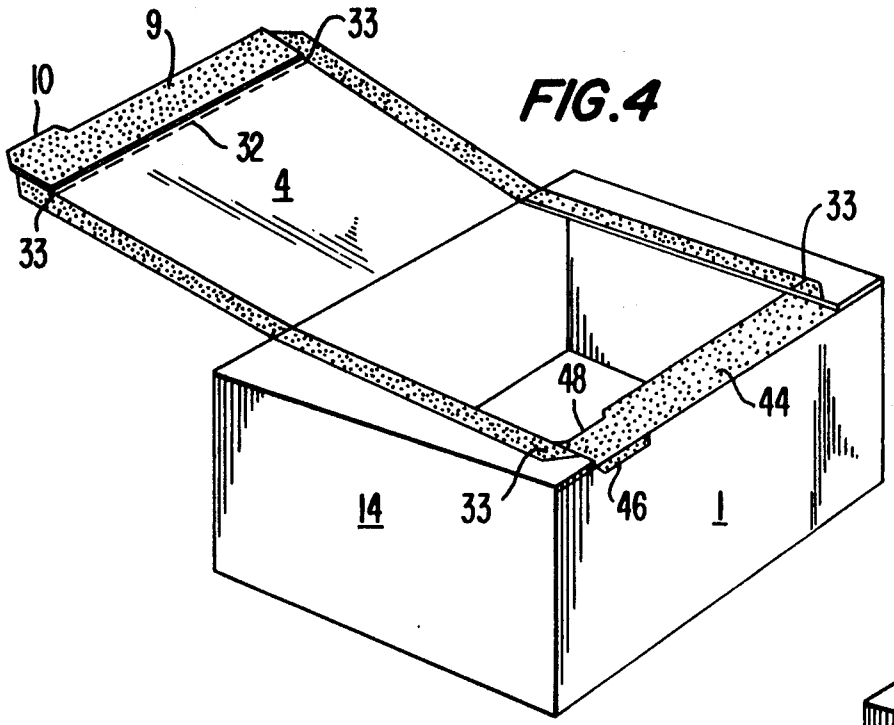
FIG. 4 is a perspective view of the carton of FIG. 2 in its fully open condition.
Figure 5:
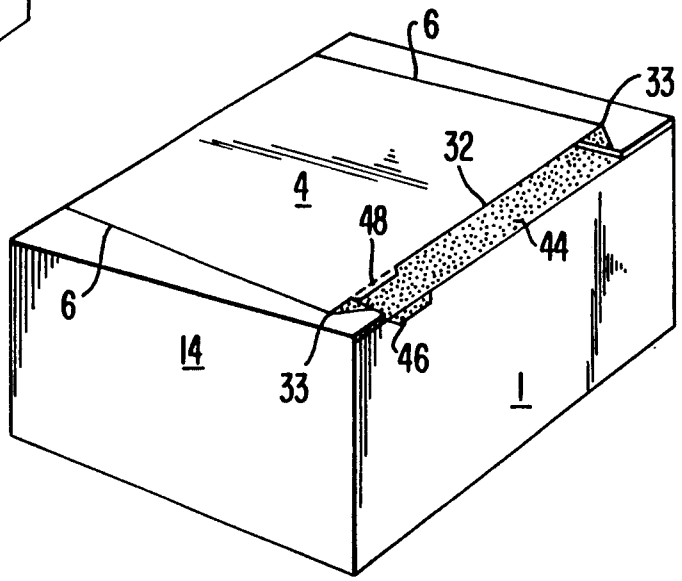
FIG. 5 is a perspective view of the carton of FIG. 2 in its reclosed condition.

Once this occurs, the carton may be entirely opened as illustrated in FIG. 4, thereby permitting access to the contents of the carton by the consumer. As can be readily seen from FIGS. 3 and 4, upon the opening of the carton, the cutout 48 is readily exposed. Often for microwave purposes or conventional heating purposes, the cartons need be initially opened to allow for the egress of steam from within the carton during the heating of the contents. Additionally, often the consumer must add a liquid such as water to the contents prior to their heating. Once the carton is opened, as shown in FIG. 4, the opening flap 9 can be folded along the line of weakness 32, and inserted through the through cuts 33 as illustrated in FIG. 5. Additionally, the counterpart through cuts 33 formed in the open portion of the top panel 4 will act to hold the top panel 4 in the closed condition until again opened by the consumer. Once in the closed condition, because the opening flap 9 has been folded back towards the inner surface of the top panel 4, the cut out 48 is readily exposed thereby forming a vent in the top panel of the carton which allows for the egress of steam from the internal portion of the carton while keeping the contents within the carton.

Once the contents of the carton have been heated to the desired temperature, the consumer may readily reopen the carton by depressing the release area 44, pressing against the line of weakness 32 and lifting.

While the invention has been described in connection with the carton of the above-mentioned type, the disclosed opening feature may be provided on any type of carton where it is desired to have an opening mechanism which allows for the ready access to the contents of the carton and which when reclosed forms a vent opening for the egress of steam during the heating of the contents. Further, the panels and sidewalls of the present invention may take any configuration and that configuration disclosed is only exemplary of the application of the opening feature of the present invention.

While the present invention has been described with reference to a preferred embodiment, it will be appreciated by those skilled in the art that the invention may be practiced otherwise than as specifically described herein without departing from the spirit and scope of the invention. It is, therefore, to be understood that the spirit and scope of the invention be limited only by the appended claims.

INDUSTRIAL APPLICABILITY

The above-described opening feature may be incorporated in any paperboard type carton wherein it is desired to provide a mechanism for gaining easy access to the contents of a carton while maintaining the carton capable of being readily reclosed in order to form a vent in the carton for permitting the egress of steam from within the carton during the heating of its contents. The present invention is particularly suitable for microwavable containers wherein the consumer may store, heat and consume the contents thereof while in the container.

What is claimed is:

1. A carton blank formed of a paperboard material for forming a paperboard carton, said blank comprising:

a first panel having side walls connected thereto by scored fold lines formed between a respective one of said side walls and a respective edge of said first panel;

a second panel having side walls connected thereto by scored fold lines formed between a respective one of said side walls and a respective edge of said second panel, one of said side walls of said first panel and one of said walls of said second panel being congruent, at least one predetermined edge of said second panel being devoid of a side wall;

a seal flap extending a predetermined distance from a predetermined edge of one of said side walls of said first panel, said predetermined edge of said side wall being that edge which extends adjacent to said predetermined edge of said second panel of a carton formed from the blank;

an opening means defined by said predetermined edge of said second panel and regions of weakness formed in said second panel and extending from said predetermined edge of said second panel for permitting access to the inside of the formed carton, said opening means including;

an opening force receiving means defined by said regions of weakness, said predetermined edge of said second panel and a line of weakness extending between said regions of weakness and substantially parallel to said predetermined edge of said second panel;

wherein said line of weakness is spaced from said predetermined edge of said second panel a distance equal to or greater than said predetermined distance of said seal flap.

2. The blank as defined in claim 1, wherein each of said regions of weakness includes an inner partially cut score line and an outer partially cut score line, said inner and outer partially cut score lines extend substantially parallel to one another.

3. The blank as defined in claim 2, wherein said line of weakness is a crease score fold line.

4. The blank as defined in claim 3, wherein said fold line extends between said inner partially cut score lines.

5. The blank as defined in claim 4, further comprising a through cut extending between each of respective inner and outer partially cut score lines, said through cuts being substantially coextensive with said fold line.

6. The blank as defined in claim 5, wherein respective inner and outer partially cut score lines converge towards one another in a region between said predetermined edge of said second panel and said fold line.

7. The blank as defined in claim 6, further including lead-in through cut lines extending from said predetermined edge of said second panel to a point of intersection of said respective inner and outer partially cut score lines.

8. The blank as defined in claim 7, wherein said seal flap includes a release area underlying said opening force receiving means for permitting said opening force receiving means to be released from said seal flap.

9. The blank as defined in claim 8, wherein said release area is defined by a partially cut score line extending substantially coextensive with said predetermined edge of said side wall and partially cut score lines which substantially underlie said lead-in through cuts formed in said second panel of the formed carton so that a ply separation occurs in said release area in response to an opening force being applied to said opening force receiving means of the formed carton.

10. The blank as defined in claim 9, further comprising a venting means formed in said sealing flap for permitting the egress of steam from within the formed carton when contents of the carton are being heated.

11. The blank as defined in claim 10, wherein said venting means is a cut-out section of said sealing flap.

12. The blank as defined in claim 11, wherein said cut-out section includes an edge of said seal flap which extends substantially parallel to said predetermined edge of said one of said side walls.

13. A carton for containing a product placed therein, said carton comprising:

a bottom panel;

a top panel;

a plurality of side walls extending from said bottom panel to said top panel;

a seal flap extending a predetermined distance from a predetermined edge of one of said side walls, said predetermined edge of said side wall being that edge which extends adjacent to a predetermined edge of said top panel;

an opening means defined by said predetermined edge of said top panel and regions of weakness formed in said top panel and extending from said predetermined edge of said top panel for permitting access to the inside of the carton, said opening means including;

an opening force receiving means defined by said regions of weakness, said predetermined edge of said top panel and a line of weakness extending between said regions of weakness and substantially parallel to said predetermined edge of said top panel;

wherein said line of weakness is spaced from said predetermined edge of said top panel a distance equal to or greater than said predetermined distance of said seal flap.

14. The carton as defined in claim 13, wherein each of said regions of weakness includes an inner partially cut score line and an outer partially cut score line, said inner and outer partially cut score lines extend substantially parallel to one another.

15. The carton as defined in claim 14, wherein said line of weakness is a fold line.

16. The carton as defined in claim 15, wherein said fold line extends between said inner partially cut score lines.

17. The carton as defined in claim 16, further comprising a through cut extending between each of respective inner and outer partially cut score lines, said through cuts being substantially coextensive with said fold line.

18. The carton as defined in claim 17, wherein respective inner and outer partially cut score lines converge towards one another in a region between said predetermined edge of said top panel and said fold line.

19. The carton as defined in claim 18, further comprising lead-in through cut lines extending from said predetermined edge of said top panel to a point of intersection of said respective inner and outer partially cut score lines.

20. The carton as defined in claim 19, wherein said seal flap includes a release area underlying said opening force receiving means for permitting said opening force receiving means to be released from said seal flap.

21. The carton as defined in claim 20, wherein said release area is defined by a partially cut score line extending substantially coextensive with said predetermined edge of said side wall and partially cut score lines which substantially underlie said lead-in through cuts formed in said top panel so that a ply separation occurs in said release area in response to an opening force being applied to said opening force receiving means.

22. The carton as defined in claim 21, further comprising a venting means formed in said sealing flap for permitting the egress of steam from within the carton when the product contained in the carton is heated.

23. The carton as defined in claim 22, wherein said venting means is a cut-out section formed in said sealing flap.

24. The carton as defined in claim 23, wherein said cut-out section is formed in an edge of said sealing flap which extends substantially parallel to said predetermined edge of said one of said side walls.

* * * * *